US006949029B1

(12) United States Patent
Strande

(10) Patent No.: US 6,949,029 B1
(45) Date of Patent: Sep. 27, 2005

(54) GOLF SWING PATH AND ALIGNMENT TRAINING DEVICE

(76) Inventor: Paul J. Strande, 1540 Thomas Lake Rd., #219, Eagan, MN (US) 55122

( * ) Notice: Subject to any disclaimer, the term of this patent is extended or adjusted under 35 U.S.C. 154(b) by 234 days.

(21) Appl. No.: 09/676,323

(22) Filed: Sep. 29, 2000

Related U.S. Application Data

(60) Provisional application No. 60/156,904, filed on Sep. 30, 1999.

(51) Int. Cl.[7] ..... A63B 69/36
(52) U.S. Cl. ..... 473/257; 473/218; 473/270
(58) Field of Search ..... 473/257, 218, 473/278, 268, 261, 262; 434/252

(56) References Cited

U.S. PATENT DOCUMENTS 1,484,064 A * 2/1924 Taylor et al. ..... 473/218
1,596,110 A * 8/1926 Lynch
2,652,251 A * 9/1953 Molinar
3,542,369 A * 11/1970 Andrson
3,561,764 A * 2/1971 Thomas
3,580,584 A * 5/1971 Trosko
3,899,179 A * 8/1975 Vlach
4,915,387 A * 4/1990 Baxstrom ..... 473/218
5,335,915 A * 8/1994 Baudier
5,350,177 A * 9/1994 Furbush, Jr.
5,388,833 A * 2/1995 Goyen, Jr.
5,954,592 A * 9/1999 Laffer et al.

OTHER PUBLICATIONS

Blair C. Douglass, article entitled, "Vision Track, Correct Swing Path".

* cited by examiner

*Primary Examiner*—Gregory Vidovich
*Assistant Examiner*—Nini F. Legesse
(74) *Attorney, Agent, or Firm*—Dicke, Billig & Czaja, PLLC

(57) ABSTRACT

A golf swing path training device for visually guiding a golfer through a proper swing path and properly align the golfer's stance includes an arm path member and a body path member. The arm path member and the body path member are preferably integrally formed such that a central portion of the arm path member is connected to a central portion of the body path member. The central portion of the arm path member is substantially straight, whereas the central portion of the body path member is substantially arcuate. During a swing, the arm path member visually directs the golfer to maintain a substantially straight or vertical arm path during the back swing. Conversely, the body path member, visually directs the golfer to maneuver his or her body in a rotating fashion throughout the golf swing.

23 Claims, 1 Drawing Sheet

GOLF SWING PATH AND ALIGNMENT TRAINING DEVICE

This application claims domestic priority from earlier filed provisional application Ser. No. 60/156,904, filed Sep. 30, 1999.

BACKGROUND OF THE INVENTION

The present invention relates to an apparatus for assisting a golfer in performing a proper golf swing. More particularly, it relates to an apparatus configured to provide a direct visual indication of proper arm and body motion during a golf swing, as well as a correct stance alignment.

Over the past several decades, golf has become an extraordinarily popular pastime. Literally millions of people avidly participate in this sport, with tens of thousands of new golfers taking up the same annually. As with any other athletic endeavor, skill levels and abilities vary greatly from golfer to golfer. On the one hand, the disparity in skill level can be attributed to basic athletic ability, such as hand-eye coordination. Importantly, however, even athletically inclined individuals encounter great difficulties in mastering the proper golf swing. This difficulty can be attributed to the many variables associated with the golf swing, including grip, stance, arm motion, body motion, club direction, weight shift and distribution, etc.

In light of the complex nature of a golf swing, many golfers invest time and money in hopes of "perfecting" their golf swing. To this end, teaching professionals are invaluable resources. Additionally, a large number of mechanical teaching aids are available. These teaching aids may be used by the individual golfer, or may be employed by a teaching professional. The teaching aids assume a wide variety of forms, ranging from unique golf club grips and heads to intricate mechanisms worn by the golfer.

Regardless of the exact form, golf swing teaching aids have a common goal; to assist the golfer in "learning" a proper golf swing. To this end, a vast majority of the teaching aids are designed to teach the golfer, at an almost subconscious level, certain golf swing alterations or improvements. Through a large number of golf swing repetitions with the teaching aid in place, it has been found that the golfer's mind and body are "trained" to subsequently repeat the swing correction with the teaching aid removed. For example, a uniquely configured strap may be worn by a golfer to keep the golfer's left elbow (for a right-handed golfer) close to his or her body during the golf swing. The generally accepted belief is that by performing a large number of swings with the device in place, the golfer's mind and body will subconsciously "memorize" the proper arm placement so that subsequent swings taken without the strap will still result in proper elbow placement.

While several of the available teaching aids have achieved some success, no one device is universally accepted. This may be due to the above-described approach of "training" the golfer's mind and body to perform a particular swing correction by constraining a portion of the golfer's body and/or hands during repeated practice swings. Effectively, these teaching aids "trick" the mind and body to perform a golf swing differently from how the golfer would swing naturally. Once the device is removed, over time the golfer's mind and body may "forget" the swing correction, reverting to the natural form, including certain swing imperfections. A more preferred approach would be to provide the golfer with a direct visual indication of the proper swing technique during each practice swing. This same ideology holds true for teaching professionals. The professional may be able to orally explain proper swing kinematics prior to a practice swing. However, during an actual swing, the golfer has no visual clues and is instead forced to attempt to remember the instructor's tips concurrent with the swing itself. Obviously, this is a difficult task in that a golf swing is less than two seconds in duration.

As previously described, the proper golf swing includes many components. In most basic terms, however, the proper golf swing requires the golfer to maneuver his or her arms in a vertically planar swing path that is preferably "straight" during a back stroke as well as just prior to and following golf ball impact during the down stroke. Conversely, the golfer's body (other than the arms) preferably moves in a rotating fashion to properly distribute weight and position the club face throughout the swing. Essentially, the arms swing in a vertical plane, whereas the body turns about a horizontal plane. It has been estimated that 75% of all golfers make the fundamental mistake of swinging the club inside horizontally around their hips or ankles. Even though a proper golf swing entails a circular arm motion, the club must be moved straight back the first few inches of the swing in order for the club to swing over the back shoulder in the correct swing plane. The various teaching aids strive to address these objectives. Unfortunately, because no visual indication is provided to the golfer of these essential swing parameters, it is unlikely that a long-term swing correction can be achieved with currently available teaching aids. Further, while the above-stated objectives may appear simplistic in nature, teaching aids have become increasingly complex, and therefore expensive. Thus, most teaching aids are ineffective from both a practical and cost standpoint.

Golf continues to be an extremely popular sport. Few participants, however, have been able to perfect and consistently perform a proper golf swing. The plethora of available teaching aids, regardless of complexity, have not been able to adequately guide a golfer through a proper swing pattern, especially on a visual basis. An additional detriment to most teaching aids are the excessive costs. Therefore, a need exists for an inexpensive golf swing path training device configured to provide a direct visual indication of proper swing technique.

SUMMARY OF THE INVENTION

One aspect of the present invention relates to a golf swing path training device for visually guiding a golfer through a proper swing path. The golf swing path training device includes an arm path member and a body path member. The arm path member includes a leading end, a central portion and a trailing end. Similarly, the body path member includes a leading end, a central portion and a trailing end. The arm path member and the body path member are preferably integrally formed such that the central portion of the arm path member is connected to the central portion of the body path member. The central portion of the arm path member is substantially straight, whereas the central portion of the body path member is substantially arcuate. With these attributes in mind, the golf swing path training device is configured to be placed on the ground in front of a golfer. During a swing, the arm path member, and in particular the substantially straight central portion, visually directs the golfer to maintain a substantially straight arm swing path during the back swing. Conversely, the body path member, and in particular the substantially arcuate central portion, visually directs the golfer to maneuver his or her body in an arcuate or rotating fashion throughout the golf swing.

Due to its integral form, the golf swing path training device of the present invention is convenient to transfer from location to location, as well as to properly orientate in front of a golfer. That is to say, no complex assembly is required, and each of the arm path member and the body path member are consistently orientated in a proper fashion. Additionally, the golf swing path training device is relatively simple and therefore inexpensive. In one preferred embodiment, the golf swing path training device further includes a club path indicator for visually guiding the golfer to properly maneuver and position the club head during the golf swing both before and after golf ball impact. In another preferred embodiment, the curved nature of the body path member provide a visual indication of an incorrect swing path to the golfer.

BRIEF DESCRIPTION OF THE DRAWINGS

The FIGURE is a top view of a golf swing path training device in accordance with the present invention.

DESCRIPTION OF THE PREFERRED EMBODIMENTS

Figure 1:
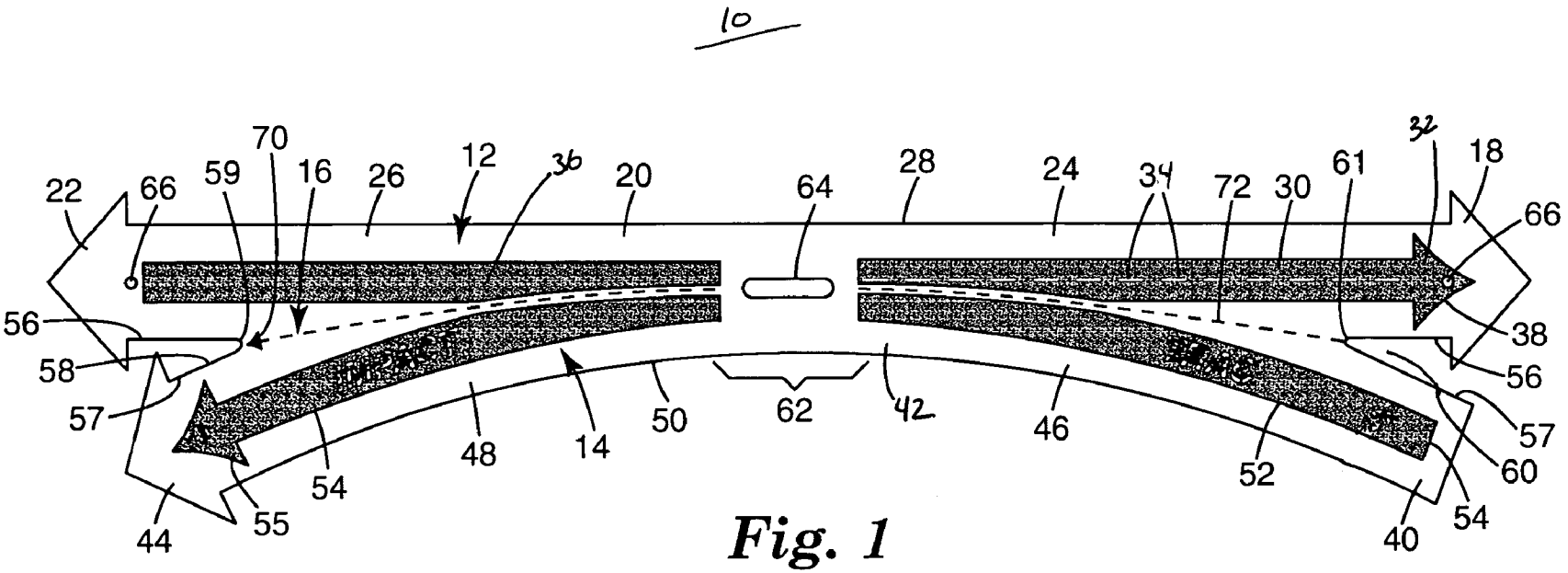

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

One preferred embodiment of a golf swing path training device 10 is shown in the FIGURE. The golf swing path training device 10 includes an arm path member 12, a body path member 14 and a down swing club path guide 16. As described in greater detail below, the arm path member 12 is connected to the body path member 14. Further, the down swing club path guide 16 is formed along a portion of the combination of the arm path member 12 and the body path member 14.

For one preferred embodiment, the arm path member 12 includes a trailing end 18, a central portion 20 and a leading end 22. The central portion 20 defines a back swing section 24 and a target line section 26. As described in greater detail below, the back swing section 24 is configured to direct a user to maintain a relatively straight arm path during a back swing. The target line section 26 is configured to properly align the training device 10 relative to a desired target (not shown). In other words, by "aiming" the target line section 26 at a desired target, a user will properly align his or her stance relative to the desired target.

It should be noted that directional terminology used throughout this specification, such as "leading," "trailing," "back swing" and "down swing" are used for purposes of illustration and are in no way limiting. That is to say, orientation of the golf swing path training device 10 is depicted in FIG. 1 for a right-handed golfer. Therefore, the trailing end 18 is positioned for directing arm path during a back swing or stroke of a right-handed golfer; whereas the leading end 22 points a right-handed golfer toward a desired target. Alternatively, the golf swing path training device 10 may be configured for a left-handed golfer such that the trailing end 18 and the leading end 22 are reversed. In fact, the golf swing path training device 10 is preferably configured to include identical attributes (including shapes and indicia) on a reverse side (i.e., opposite the side shown in FIG. 1). Thus, the golf swing path training device 10 can simply be turned over for a left-handed golfer.

Regardless of exact orientation, the trailing end 18 and the leading end 22 are integrally formed with the central portion 20. In other words, the trailing end 18 is formed as an extension of the back swing section 24, whereas the leading end 22 extends from the target line section 26. As shown in FIG. 1, the trailing end 18 and the leading end 22 are preferably formed in the shape of an arrowhead. This arrow head configuration for the trailing end 18 visually highlights to a user that the back swing section 24 relates to the back swing itself. That is to say, the arrowhead 18 points in the direction of the back swing so that a user will understand to follow the arm path provided by the back swing section 24 during the back swing. Conversely, the arrowhead configuration for the leading end 22 facilitates straightforward alignment of the target line section 26 with a desired target (e.g., the arrowhead points at the desired target). Alternatively, other shapes may also be acceptable.

The central portion 20 of the arm path member 12 is preferably substantially straight in the plane of FIG. 1. Thus, both the back swing section 24 and the target lines section 26 are linearly arranged. Notably, this linear orientation is best illustrated with reference to an outer edge 28 of the central portion 20. With this configuration, the arm path member 12 visually guides a golfer (not shown) to maintain a substantially straight arm swing during the back swing. To this end, it should be understood that even though a golf swing is circular, the club must be brought straight back during the initial stage of the back swing. The arm path member 12 emphasizes this proper technique.

As an additional visual guide to proper back swing arm movement, in one preferred embodiment, the arm path member 12 further includes back swing indicia 30. The back swing indicia 30 is disposed along a top face (shown in FIG. 1) of the back swing section 24, and preferably comprises a darkened line terminating in an arrowhead 32. The back swing indicia 30 is, once again, substantially straight for visually highlighting proper arm swing path during the back stroke and may include differently colored dashes 34 to further indicate back stroke direction. In this regard, the dashes 34 effectively appear as a "roadway" such that the user is visually prompted to "take the high road" during the back swing. The arrowhead 32 is formed adjacent the trailing end 18 of the arm path member 12, preferably corresponding with the arrowhead formed by the trailing end 22.

To visually distinguish the target line section 26 from the back swing section 24, the target line section 26 preferably includes target indicia 36. The target indicia 36 is preferably a solid line so as to differentiate from the dashes to associated with the back swing indicia 30.

The body path member 14 includes a trailing end 40, a central portion 42 and a leading end 44. The central portion 42 further defines a back swing section 46 and a follow through section 48. As with arm path member 12, the body path member 14 is preferably integrally formed, with the central portion 42 terminating in the trailing end 40 and the leading end 44. Unlike the arm path member 12, however, the central portion 42 of the body path member 14 is preferably arcuate in form. Thus, the back swing section 46 and the follow through section 48 combine to define a substantially continuous curve. This curved configuration is be illustrated with reference to an outer edge 50 of the central portion 42 and provides a visual indication of proper horizontal body rotation or movement during a golf swing. To provide further visual assistance in this regard, the leading end 44 of the body path member 14 preferably forms an arrowhead, whereas the trailing end 40 is preferably linear or straight. By providing an arrowhead for the leading end 44, the body path member 14 visually guides the golfer to perform a complete follow through motion in which the golfer's body continues to rotate throughout the swing. As a further benefit, the body path member 14 visually represents to the user an incorrect swing path. In particular, and as previously described, a common golf swing flaw is a failure to bring the club straight back during initial stages of the back stroke. In fact, an all too common problem is that a golfer will bring the club back in a curved fashion (i.e., swinging inside horizontally around the hips or ankles). The curved nature of the body path member 14 provides a direct visual indication of this incorrect swing format to the user.

As with the arm path member 12, the body path member 14 preferably further includes back swing or stroke indicia 52 and follow through or down swing indicia 54. The back swing indicia 52 is preferably disposed along a top face (illustrated in FIG. 1) of the back swing section 46 and is preferably a darkened line having a shape corresponding with that of the back swing section 46. Therefore, the back swing indicia 52 is arcuate or curved, terminating in a linear end 54 corresponding with the trailing end 40. Once again, the back swing indicia 52 visually highlights that a proper swing path includes rotation of the body during the back-stroke.

The follow through indicia 54 is disposed along the follow through section 48 of the central portion 42 and is preferably a darkened line terminating in an arrow head 55. Once again, the follow through indicia 54 corresponds with a shape of the follow through section 48 and is therefore preferably arcuate or curved. Further, the arrowhead 55 is positioned adjacent the leading end 44. With this configuration, the follow through indicia 54 provides a visual indication to the golfer (not shown) of proper body motion during the follow through portion of the swing subsequent to impact.

The arm path member 12 and the body path member 14 are preferably integrally formed such that at least a portion of the arm path member 12 is connected to a portion of the body member 14. The integral formation of the arm path member 12 and the body path member 14 creates a single monolithic unit. As shown in FIG. 1, for example, the central portion 20 of the arm path member 12 is connected to the central portion 42 of the body path member 14.

As shown in FIG. 1, however, the connection of the central portions 20, 42 does not interfere with formation of arrow heads at the trailing end 18 and the leading end 22 of the arm path member 12, or at the leading end 44 of the body path member 14. In particular, the arm path member 12 further includes inner edge 56 and body path member 14 further includes inner edge 57. Adjacent the leading ends 22, 44 of the respective arm path member 12 and body path member 14, these inner edges 56, 57 together form a first acute angle 58 with vertex 59. Adjacent the trailing ends 18, 40 of the respective arm path member 12 and body path member 14, these inner edges 56, 57 together form a second acute angle 60 with vertex 61. The arrowhead 70 of the club path indicator 16 is disposed adjacent the vertex 59 of the first acute angle 58 and a trailing end 72 of the club path indicator 16 is disposed adjacent the vertex 61 of the second acute angle 60.

This arrangement, in combination with the commonality of central portions 20, 42 of the respective arm path member 12 and body path member 14, creates a unique appearance that accentuates a contact zone 62 where the arm swing indicators, body path indicators, and club path indicators converge at and about the location of the ball adjacent central portions 20, 42. This arrangement also creates a separation zone highlighted by the divergence of the arm path member 12 and the body path member 14 at the leading end by first acute angle 58 and at the trailing end by second acute angle 60. This diverging pattern helps the golfer visualize and actualize the divergence of the path of the golfer's arms from the golfer's body both on the back swing and on the follow through. Conversely, the contact zone 62 highlights the golfer's expected convergence of the orientation of golfer's arms and body as the club contacts the ball.

Integral formation of the arm path member 12 and the body path member 14 preferably provides for a slot 64 and a plurality of holes 66. The slot 64 is centrally disposed along the arm path member 12 and the body path member 14, and extends through a thickness of the golf swing path training device 10. The slot 64 has a longitudinal axis that is aligned generally tangential to an apex of the generally arcuate club path indicator 16. Further, the slot 64 is formed to have a length and width sufficient for insertion of a golf tee (not shown) therethrough. Thus, when the golf swing path training device 10 is placed on the ground (and thus in the orientation of FIG. 1), the golf tee can be inserted through the slot 64 and secured to the ground. Subsequently a golf ball (not shown) can be placed on top of the golf tee, as would normally be done without the training device 10 in place. The holes 66 similarly extend through a thickness of the golf swing path training device 10 and are preferably located at the trailing end 18 and the leading end 22 of the arm path member 12. Additional holes can also be formed in the body path member 14. Regardless, the holes 66 are preferably sized to have a diameter slightly greater than a diameter of a golf tee shaft such that the golf swing path training device 10 can be selectively secured to the ground via simple placement of tees through the holes 66.

With the above-described integral formation of the arm path member 12 to the body path member 14 in mind, the down swing club path guide 16 is preferably formed along a connection point between the two central portions 20, 42. In one preferred embodiment, the down swing club path guide 16 assumes a dashed line format, so as to be visually distinguishable from the various other indicia 30, 36, 52, 54. Further, as shown in FIG. 1, the dashed line comprising the down swing club path guide 16 is preferably curved or arcuate, thereby representing a proper club path direction during the down swing and follow through. Finally, the down swing club path guide 16 preferably terminates in an arrowhead 70 adjacent the leading end 22, 44 of the arm path member 12 and the body path member 14, respectively. The arrowhead 70 provides a visual indication of proper follow through direction of the club head (not shown).

In one preferred embodiment, the golf swing path training device 10 is formed from a rigid plastic, such as high-density polyethylene. The down swing club path guide 16 as well as the various indicia 30, 36, 52, 54 are subsequently printed onto the plastic material with an ink. Alternatively, a stenciling technique, or any other acceptable printing process may be used. Regardless of exact composition, the golf swing path training device 10 preferably has a uniform thickness of about 3/16–1/4 inch and a length of approximately 42 inches. With these dimensions, a golf tee (not shown) inserted through the slot 64 will extend above the golf swing path training device 10 such that the device 10 will not interfere with a golf swing during use.

During use, the golf swing path training device 10 is orientated relative to a desired target (not shown) such that the leading end 22 of the target line section 28 points toward the target. The device 10 is then secured to the ground, such as, for example, by golf tees (not shown) inserted through the holes 66. An additional golf tee (not shown) is inserted through the slot 64 into the ground and a golf ball (not shown) placed on top thereof. A golfer (not shown) addresses the golf ball in a normal fashion. To this end, the device 10 serves to properly align the golfer's stance relative to the target. The golfer then begins to swing the golf club. During the backstroke portion of the golf swing, the arm path member 12 visually indicates to the golfer a substantially straight or vertical arm swing path. The body path member 14, conversely, indicates a rotation of the body via the curve configuration, as well as incorrect swing path. Thus, the golfer maintains a vertical arm path and horizontal body path. During the subsequent down swing, the down swing club path guide 16 visually guides the golfer to direct the club head toward the golf ball along an arcuate path, whereas the body path member 14 indicates a rotation of the body (and therefore a proper weight shift). Following impact with the golf ball, the down swing club path guide 16 continues to provide a visual indication of an arcuate club path; whereas the body path member 14 visually indicates a complete body rotation during follow through.

The golf swing path training device of the present invention provides a marked improvement over other available training aids. In particular, the golf swing path training device gives multiple, direct visual indications to a golfer of proper swing technique. Thus, the golfer is not required to rely upon a subconscious swing memory to achieve golf swing correction. In fact, it is likely that following repeated use, the golfer's minds eye will remember the visual cues provided by the golf swing path training device during actual play. Finally, due to its integral formation, the golf swing path training device of the present invention is easy to transport from location to location, and requires no assembly for use. Along these same lines, the golf swing path training device is inexpensive, easy to use, durable and long lasting.

Although the present invention has been described with reference to preferred embodiments, workers skilled in the art will recognize that changes may be made in form and detail without departing from the spirit and scope of the invention.

What is claimed is:

1. A golf swing aid for guiding a user through a golf swing when the user addresses a golf ball positioned at a center of the aid such that in relation to a stance of the user upon addressing the golf ball, the aid defines a forward extension and a rearward extension relative to the center, the golf swing aid comprising:

an arm path member having a substantially linear, elongate shape and having a leading end, a central portion, and a trailing end;

a body path member having a generally arcuate shape with a leading end, a central portion and a trailing end, with the central portion being integrally connected together with the central portion of the arm path member as a monolithic unit; wherein the ends of the body path member are detached from the arm path member; and wherein an outer edge of the arm path member defines a straight edge forward and rearward of the center and an outer edge of the body path member defines a curved edge.

2. The golf swing aid of claim 1, wherein the arm path member includes a directional arrow disposed at each of the leading and trailing ends of the arm path member, with the directional arrows pointing in opposite directions relative to one another.

3. The golf swing aid of claim 1, and further comprising:

a generally arcuate-shaped down swing club path guide arranged between the arm path member and the body path member, wherein the down swing club path guide defines a radius of curvature greater than that of the body path member.

4. The golf swing aid of claim 3, wherein the down swing club path guide is spatially fixed relative to the arm path member and the body path member.

5. The golf swing aid of claim 1, wherein a junction of the central portions of the arm path member and the body path member defines an elongate hole for receiving a golf tee.

6. The golf swing aid of claim 1, wherein the central portion of the arm path member further includes a target line indicia disposed adjacent the leading end and a back swing indicia disposed adjacent the trailing end.

7. The golf swing aid of claim 6, wherein the back swing indicia includes a generally straight solid line.

8. The golf swing aid of claim 6, wherein the target line indicia includes a generally straight solid line.

9. The golf swing aid of claim 1, wherein the body path member includes a back swing portion and a follow through portion, with the back swing portion and the follow through portion each have a generally arcuate shape generally matching the curvature of the body path member.

10. The golf swing aid of claim 9, wherein both the back swing portion and the follow through portion include an indicia formed thereon and having a shape generally matching the curvature of the respective follow through portion and back swing portion.

11. The golf swing aid of claim 1, wherein the body path member is configured to visually indicate an incorrect swing path.

12. The golf swing aid of claim 1, and further comprising:

a first anchoring hole adjacent the leading end of the arm path member;

a second anchoring hole adjacent the trailing end of the arm path member; and an elongate golf tee hole centrally located at a junction between the arm path member and the body path member.

13. The golf swing aid of claim 1, wherein an inner edge of the arm path member and an inner edge of the body path member adjacent the respective leading ends of the arm path member and the body path member define a first acute angle therebetween having a vertex.

14. The golf swing aid of claim 13, wherein the inner edge of the arm path member and the inner edge of the body path member adjacent the respective trailing ends of the arm path member and the body path member define a second acute angle therebetween having a vertex.

15. The golf swing aid of claim 14, and further comprising a club path indicator extending through a junction of the arm path member and the body path member with a leading end of the club path indicator disposed adjacent to the vertex of the first acute angle and a trailing end of the club path indicator disposed adjacent the vertex of the second acute angle.

16. The golf swing aid of claim 1, wherein the body path member is rigidly affixed to the arm path member.

17. The golf swing aid of claim 1, wherein the central portion of the arm path member extends forwardly and rearwardly relative to the center, the forward and rearward extensions of the arm path member defining a straight outer edge.

18. A golf swing aid comprising:

an arm path member having a generally straight shape and including a trailing end, a leading end, and an outer edge that is generally straight;

a body path member having a generally arcuate shape and include a trailing end, a leading end, and an outer edge that is generally arcuate shape;

wherein the arm path member and body path member together define a monolithic unit and have a common central portion with the leading ends of the arm path member and the body path member diverging from each other and the trailing ends of the arm path member and the body path member diverging from each other.

19. The golf swing aid of claim 18, comprising:

a substantially straight, arm path indicator imposed on the arm path member and being generally parallel to the outer edge of the arm path member;

a body path indicator imposed on the body path member; and a club path indicator disposed on the common central portion of, and extending between, the arm path member and the body path member.

20. The golf swing aid of claim 19, wherein the common central portion of the arm path member and the body path member further includes a centrally located elongate hole adapted for receiving a golf tee with the elongate hole extending generally parallel to the arm path indicator.

21. The golf swing aid of claim 19, and further comprising:

a directional arrowhead disposed on each of the leading and trailing ends of the arm path member, with the directional arrowheads pointing in opposite directions.

22. The golf swing aid of claim 21, and further comprising:

a target-line indicator disposed on the arm path member adjacent the leading end; and a back swing indicator disposed on the arm path member adjacent the trailing end of the arm path member, with the back swing indicator including a directional arrowhead located adjacent to and pointing in the same direction as the directional arrowhead of the trailing end of the arm path member.

23. A golf swing aid for guiding a user through a golf swing when the user addresses a golf ball positioned at a center of the aid such that in relation to a stance of the user upon addressing the golf ball, the aid defines a forward extension and a rearward extension relative to the center, the golf swing aid comprising:

an arm path member having a substantially linear, elongate shape and having a leading end, a central portion, and a trailing end; and a body path member having a generally arcuate shape with a leading end, a central portion and a trailing end, with the central portion being integrally connected together with the central portion of the arm path member as a monolithic unit;

wherein an outer edge of the arm path member defines a straight edge forward and rearward of the center and an outer edge of the body path member defines a curved edge;

a vertex of a first acute angle defined by an inner edge of the arm path member and an inner edge of the body path member adjacent the respective leading ends of the arm path member and the body path member a vertex of a second acute angle defined by the inner edge of the arm path member and the inner edge of the body path member adjacent the respective trailing ends of the arm path member and the body path member define a second acute angle therebetween having a vertex; and a club path indicator extending through a junction of the arm path member and the body path member with a leading end of the club path indicator disposed adjacent to the vertex of the first acute angle and a trailing end of the club path indicator disposed adjacent the vertex of the second acute angle.

* * * * *